United States Patent [19]

Jentzsch et al.

[11] 4,372,209

[45] Feb. 8, 1983

[54] SHEET GRIPPING JAR ARRANGEMENT

[75] Inventors: Arndt Jentzsch, Coswig; Hans Johne, Radebeul; Victor Hefftler, Coswig; Werner Kühnert, Radebeul; Reiner Karl, Coswig, all of German Democratic Rep.

[73] Assignee: Veb Kombinat Polygraph "Werner Lamberz", Leipzig, German Democratic Rep.

[21] Appl. No.: 311,294

[22] Filed: Oct. 14, 1981

[30] Foreign Application Priority Data

Nov. 17, 1980 [DD] German Democratic Rep. ... 225240

[51] Int. Cl.[3] ..... B41F 21/04

[52] U.S. Cl. ..... 101/409; 271/82

[58] Field of Search ..... 101/408, 409, 410, 246; 271/82, 85, 268, 277

[56] References Cited

U.S. PATENT DOCUMENTS

| | | | |
|---|---|---|---|
| 137,347 | 4/1873 | Cottrell | 101/409 |
| 2,088,862 | 8/1937 | Lang | 101/409 |
| 2,436,765 | 2/1948 | Davidson et al. | 101/409 X |
| 2,599,776 | 6/1952 | Peyrebrune | 101/409 |
| 2,734,454 | 2/1956 | Pabst et al. | 101/246 X |
| 3,650,211 | 3/1972 | Nentwich | 101/409 |
| 3,992,993 | 11/1976 | Kuhn et al. | 101/409 |
| 4,224,873 | 9/1980 | Wieland | 101/409 |
| 4,227,459 | 10/1980 | Jeschke | 101/246 X |
| 4,233,899 | 11/1980 | Rebez | 101/246 X |
| 4,290,595 | 9/1981 | Thunker | 271/82 X |

*Primary Examiner*—E. H. Eickholt

*Attorney, Agent, or Firm*—Michael J. Striker

[57] ABSTRACT

A sheet gripping arrangement of a rotary printing machine has a sheet gripper abutment member, a soft gripper seat member, a gripper shaft having a gripper shaft pivot point, a sheet gripping element including a gripper finger cooperating with the gripper seat member and eccentrically pivotable relative to the gripper shaft about a gripper finger pivot point so as to move first over a substantially flat gripping path and then to move during its final movement phase normally to the latter, and a threaded abutment member arranged in the finger member and acting against the sheet gripper abutment member, wherein the gripper finger member is arranged at an angle of substantially 90° to a contact point of the threaded abutment member with the sheet gripper abutment member, to the gripper finger point, and to the gripper shaft pivot point.

9 Claims, 2 Drawing Figures

SHEET GRIPPING JAR ARRANGEMENT

BACKGROUND OF THE INVENTION

The present invention relates to a sheet gripping arrangement of a rotary printing machine. Sheet gripping arrangements are known and widely utilized in rotary printing machines. A known sheet gripping arrangement has a sheet gripping element and a sheet gripper abutment member cooperating with one another. The sheet gripping element includes one holder which is loosely arranged on a gripper shaft and another holder which is fixedly arranged on the gripper shaft, wherein the holders are coupled with one another in a resilient manner. A gripper finger cooperating with the gripper shafts is also provided. Such a construction is disclosed, for example, in the U.S. Pat. No. 2,599,776. The above-described construction possesses, however, the disadvantage in the fact of the circular movement of the sheet gripping element and the partial embedding of the gripping element tip into the elastically deformable sheet material and the material of the gripper abutment member. As a result the displacement of the sheet between the gripper abutment member and the gripping element cannot be excluded and thereby a position accurate delivery of the sheet between the sheet gripping arrangement of two cylinders is not guaranteed.

SUMMARY OF THE INVENTION

Accordingly, it is an object of the present invention to provide a sheet gripping arrangement which avoids the disadvantages of the prior art.

More particularly, it is an object of the present invention to provide a sheet gripping arrangement which eliminates a displacement of the sheets between a sheet gripping element and a gripper abutment member.

In keeping with these objects and with others which will become apparent hereinafter one feature of the present invention resides, briefly stated in a sheet gripping arrangement in which a gripper fingers which cooperates with a soft gripper seat member is eccentrically pivotable relative to a gripper shaft about a gripper finger pivot point, and moves first over a substantially flat gripping path and then normally to the latter, is arranged at an angle of substantially 90° to a contact point of a threaded abutment member, the gripper finger pivot point, and the gripper shaft pivot point.

More particularly, the gripper finger is arranged at an angle of 90° to the axis of the threaded abutment member and a line connecting the gripper finger pivot point with the gripper shaft pivot point.

When the sheet gripping arrangement is designed in accordance with the present invention, a position accurate delivery of the sheet between the sheet gripping arrangements of two cylinders is performed independently from the elastic deformability of the sheet material or the sheet gripper abutment member and a displacement of the sheets between the sheet gripping element and the sheet gripper abutment member is prevented.

In accordance with another advantageous feature of the present invention, the gripper finger cooperates with the gripper shaft via two holder members of which one is loosely arranged on the gripper shaft and the other is fixedly arranged on the gripper shaft. The holder members cooperate with one another cooperate with one another in a force transmitting manner via a spring biased rod.

In accordance with still another feature of the present invention, the gripper finger cooperates with the second fixed holder member in a force-transmitting manner via the spring biased rod and a first spring.

Still a further feature of the present invention resides in the fact that the sheet gripper abutment member and the threaded abutment member are hardened.

Still a further advantageous feature of the present invention is that a curved control member cooperating with the gripper shaft is provided, wherein the curved control member is arranged so that when the threaded abutment member meets with the sheet gripper abutment member to contact the latter, the curved control member provides a relatively flat rise portion and a reverse portion for the gripper shaft.

Finally, an additional feature of the present invention resides in the fact that the threaded abutment member is adjustable in dependence upon the thickness of the sheets to be printed on.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
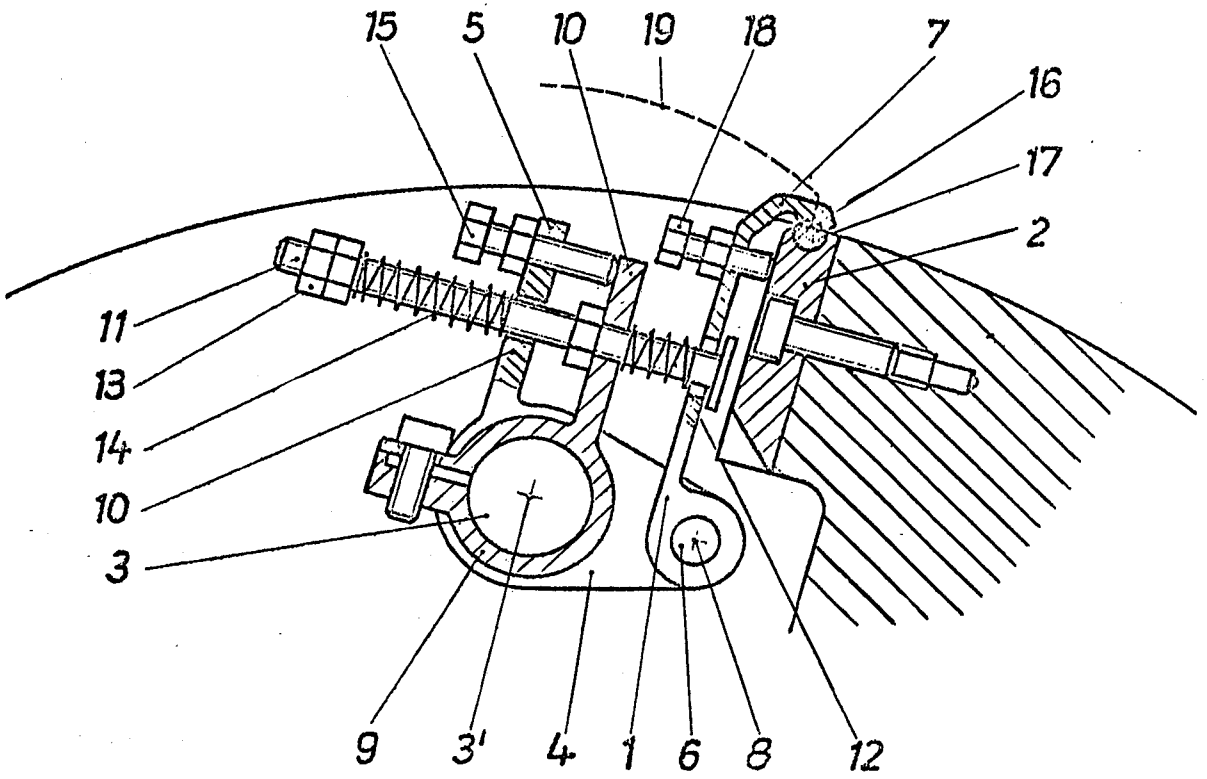
FIG. 1 is a lateral view showing a sheet gripping arrangement in accordance with the present invention.

A sheet gripping arrangement in accordance with the present invention is shown in FIG. 1 and utilized for engaging and delivering sheets.

The sheet gripping arrangement includes a sheet gripping element identified by reference numeral 1 and a sheet gripper abutment member identified by reference numeral 2. The sheet gripping element 1 includes a gripper shaft 3 having a gripper shaft pivot point 3', and a holder 4 which is loosely arranged on the gripper shaft 3. The loose holder 4 is provided with a holder arm 5 and a bearing part 6 extending eccentrically to the gripper shaft 3.

A gripper finger 7 is supported on the bearing portion 6 and is pivotable about a gripper finger pivot point 8. A holder 9 is fixedly arranged on the gripper shaft 3 and has a second holder arm 10. The gripper finger 7, the holder arm 5 of the loose holder 4, and the second holding arm 10 of the fixed holder 9 are coupled via a spring-biased rod 11.

The gripper finger 7 extends at an angle of approximately 90° to the gripper finger pivot point 8 and the gripper finger shaft pivot point 3'. A first spring 12 is provided on the spring-biased rod 11 between the gripper finger 7 and the second holder arm 10. A second spring 14 is provided on the spring-biased rod 11 between the holder arm 5 and a nut 13. An adjusting screw 15 is arranged in the holder arm 5 and abuts against the holder arm 10. It is provided for fine adjustment of a gripper tip 16 relative to a soft gripper seat member 17.

An abutment screw 18 is arranged in the gripper finger 7 which is pivotally mounted on the bearing portion 6 of the loose holder member 4. The abutment screw 18 abuts against the gripper abutment member 2. The abutment screw 18 provides for adjustment of the dimension of the paper edges to be gripped. The distance is adjusted in correspondence with the maximum sheet thickness to be treated. The abutment screw 18 and the gripper abutment member 2 are advantageously hardened. Actually, the gripper finger 7 extends at an angle substantially 90° to the axis of the threaded abutment member 18 and to a line connecting the gripper finger pivot point 8 with the gripper shaft pivot point 3'.

Figure 2:
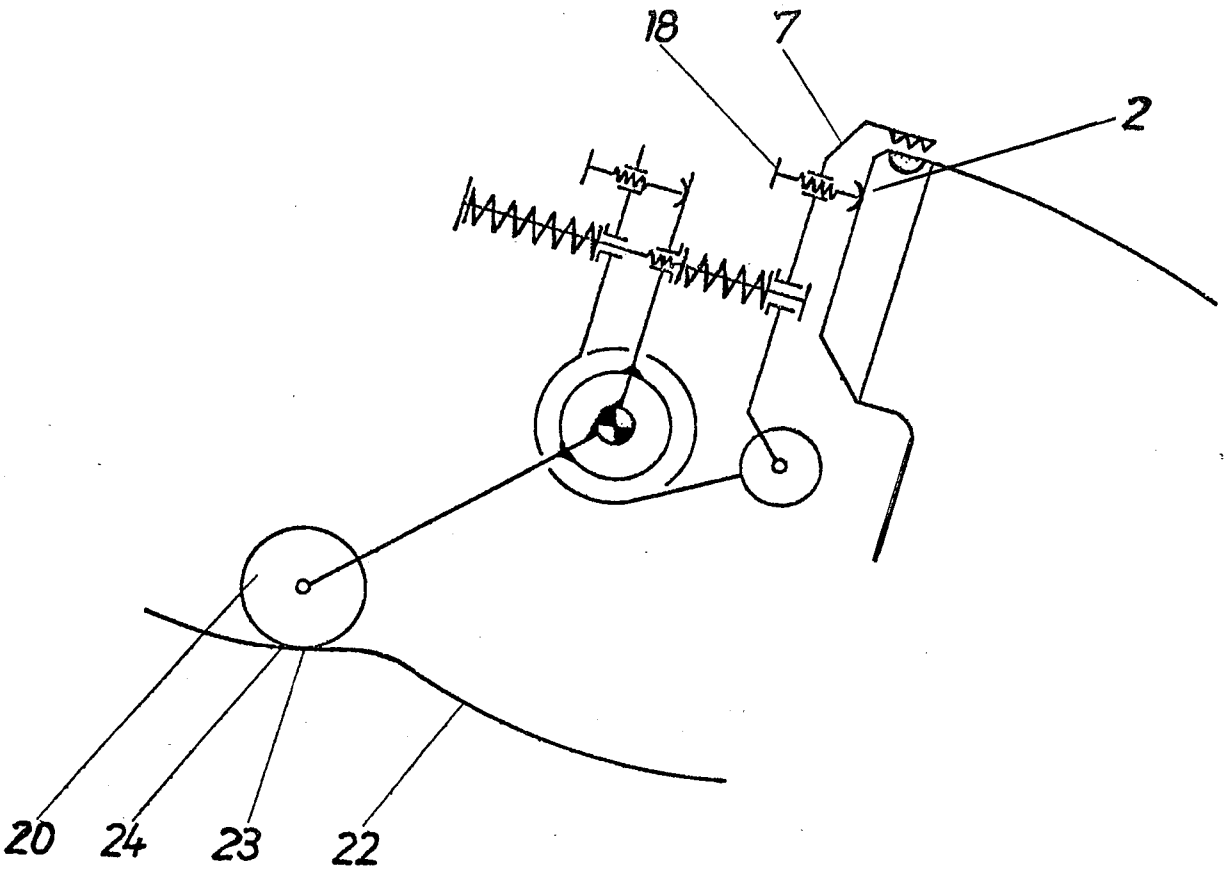
FIG. 2 is a schematic view of the inventive sheet gripping arrangement.

FIG. 2 schematically shows the inventive sheet gripping arrangement with the abutment screw 18 adjustably mounted in the gripper finger 7, the sheet gripper abutment member 2, and a roller lever 20 mounted on the gripper shaft 3. The roller lever 20 is associated with a control curve 22 which, to the time of the contact of the abutment screw 18 against the bottom gripper abutment member 2, has a reverse portion 23 and a relatively flat rise portion 24. In the inventive sheet gripping arrangement, the gripper finger 7 arranged eccentrically to the gripper shaft 3 performs, during the rotation of the gripper shaft 3 via the fixed holder member 9 and the spring-biased rod 11, a flat gripping path 19 until abutment of the abutment screw 18 against the scheet gripper abutment member 2. In the last movement phase of the closing step, a further rotation of the gripper shaft 3 causes the gripper finger 7 to move normally in a downward direction because of the abutment of the abutment screw 18 against the sheet gripping abutment member 2. Thereby, the gripper finger 7 performs during the last movement phase a normal closing movement.

In the inventive sheet gripping arrangement, a displacement of the sheets is eliminated inasmuch as the gripper finger is placed normally onto the sheet, and during the further rotation of the gripper shaft the gripper finger is pressed into the elastic material of the sheet gripper seat member. Vibrations of the gripper shaft act in the inventive construction only normally and no longer horizontally to the sheet running direction. A great holding force between the gripper finger and the sheet gripper seat member and a position accurate delivery of the sheet between the sheet gripping arrangements of two cylinders are attained in accordance with the present invention.

It will be understood that each of the elements described above, or two or more together, may also find a useful application in other types of constructions differing from the types described above.

While the invention has been illustrated and described as embodied in a a sheet gripping arrangement of a rotary printing machine it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sheet gripping arrangement of a rotary printing machine, comprising a sheet gripper abutment member; a soft gripper seat member; a gripper shaft having a gripper shaft pivot point; a sheet gripping element including a gripper finger cooperating with said gripper seat member and eccentrically pivotable relative to said gripper shaft about a gripper finger pivot point so as to move first over a substantially flat gripping path and then to move during its final movement phase normally to the latter; and a threaded abutment member arranged in said finger member and acting against said sheet gripper abutment member to have a contact point with the latter, said gripper finger being arranged at an angle of substantially 90° to said contact point of said threaded abutment member, said gripper finger pivot point, and said gripper shaft pivot point.

2. A gripper arrangement as defined in claim 1; and further comprising a first holder member loosely arranged on said gripper shaft and a second holder member fixedly arranged on said gripper shaft, said holder members being resiliently coupled with one another, said gripper finger cooperating with said gripper shaft via said holder element.

3. A gripper arrangement as defined in claim 2, wherein said first loosely arranged holder member has a first holder arm and said second fixedly arranged holder member has a second holder arm; and further comprising an adjustment screw arranged in said first holder arm so that said second holder arm abuts against said adjustment screw.

4. A gripper arrangement as defined in claim 3; and further comprising a spring rod arranged so that said second holder arm cooperates with said first holder arm via said spring-biased rod in a force-transmitting manner.

5. A gripper arrangement as defined in claim 4; and further comprising a first spring arranged so that said gripper finger cooperates with said second fixed holder member in a force-transmitting manner via said said-biased rod and said first spring.

6. A gripper arrangement as defined in claim 1, wherein said sheet gripper abutment member and said threaded abutment member are hardened members.

7. A gripper arrangement as defined in claim 1; and further comprising a curved control member cooperating with said gripper shaft and arranged so that when said threaded abutment member meets with said sheet gripper abutment member to contact the latter, said curved control member provides a relatively flat slide portion and a reverse portion for said gripper shaft.

8. A gripper arrangement as defined in claim 1; wherein said threaded abutment member is adjustable in dependence upon the thickness of sheets to be printed on.

9. A sheet gripping arrangement of a rotary printing machine, comprising a sheet gripper abutment member; a soft gripper seat member; a gripper shaft having a gripper shaft pivot point; a sheet gripping element including a gripper finger cooperating with said gripper seat member and eccentrically pivotable relative to said gripper shaft about a gripper finger pivot point so as to move first over a substantially flat gripping path and then to move during its final movement phase normally to the latter; and a threaded abutment member arranged in said finger member having an axis and acting against said sheet gripper abutment member to have a contact point with the latter, said gripper finger being arranged at an angle of substantially 90° to said axis of said threaded abutment member and to a line connecting said gripper finger pivot point, and said gripper shaft pivot point.

* * * * *